US005718391A

United States Patent [19]

Musil

[11] Patent Number: 5,718,391

[45] Date of Patent: Feb. 17, 1998

[54] GYRATORY CRUSHER HAVING DYNAMICALLY ADJUSTABLE STROKE

[75] Inventor: Joseph E. Musil, Ely, Iowa

[73] Assignee: Cedarapids, Inc., Cedar Rapids, Iowa

[21] Appl. No.: 731,331

[22] Filed: Oct. 15, 1996

[51] Int. Cl.[6] ..... B02C 4/32; B02C 2/04

[52] U.S. Cl. ..... 241/207; 241/37; 241/215; 241/208

[58] Field of Search ..... 241/207, 208, 241/214, 215, 216, 27, 63, 37

[56] References Cited

U.S. PATENT DOCUMENTS

| | | | |
|---|---|---|---|
| 2,050,718 | 8/1936 | McCaskell | 241/215 X |
| 2,052,706 | 9/1936 | Guest | 241/208 X |
| 2,224,542 | 12/1940 | Gruender et al. | 241/216 |
| 3,328,888 | 7/1967 | Gieschen et al. | 241/37 X |
| 3,797,759 | 3/1974 | Davis et al. | 241/30 |
| 3,797,760 | 3/1974 | Davis et al. | 241/30 |
| 4,084,756 | 4/1978 | Coxhill | 241/215 X |
| 4,168,036 | 9/1979 | Werginz | 241/207 X |
| 4,232,833 | 11/1980 | Werginz | 241/37 |
| 4,272,030 | 6/1981 | Afanasiev et al. | 241/37 |
| 4,410,145 | 10/1983 | Koch | 241/207 X |
| 4,651,933 | 3/1987 | Schütte et al. | 241/34 |
| 4,697,745 | 10/1987 | Sawant et al. | 241/30 |
| 4,773,604 | 9/1988 | Johnson | 241/207 |
| 4,793,560 | 12/1988 | Schrödl et al. | 241/30 |
| 4,923,129 | 5/1990 | Chae | 241/207 |
| 5,115,991 | 5/1992 | Saari | 241/208 |
| 5,312,053 | 5/1994 | Ganser, IV | 241/30 |

FOREIGN PATENT DOCUMENTS

| | | | |
|---|---|---|---|
| 2357432 | 5/1975 | Germany | 241/37 |
| 636024 | 12/1978 | U.S.S.R. | 241/207 |
| 886971 | 12/1981 | U.S.S.R. | 241/207 |
| 2059803 | 4/1981 | United Kingdom | 241/207 |

*Primary Examiner*—Daniel W. Howell
*Assistant Examiner*—Julie A. Krolikowski
*Attorney, Agent, or Firm*—Simmons, Perrine, Albright & Ellwood, PLC

[57] ABSTRACT

A gyratory crusher includes a frame structure; an eccentric member rotatably mounted to the frame structure about a first axis; a main shaft rotatably mounted to the eccentric member about a second axis angularly offset from the first axis; a crusher head mounted to the main shaft and supported by a plurality of hydrostatic bearings, mounted on the frame structure in abutting engagement with the crusher head; a first drive mechanism for rotating the eccentric member about the first axis; and a stroke adjusting mechanism having an outer race continuously and dynamically rotatable about a third axis, angularly offset from both the first and second axes, for adjusting the angular offset of the second axis relative to the first axis. A hydraulic drive mechanism, including a hydraulic motor and a rotary hydraulic connector, distribution lines and ports, for distributing pressurized hydraulic fluid to the hydraulic motor, is provided for rotating the outer race relative to the eccentric member about the third axis. A lock check valve interposed in the distribution system controls the flow of hydraulic fluid to and from the hydraulic motor. The drive mechanism includes a worm gear and a worm gear receiver matingly engaged therewith. A gap adjusting mechanism and a gyrational speed adjusting arrangement are provided for continuously and dynamically adjusting the "closed side setting" and gyrational speed of the crusher, respectively. A method for similarly adjusting the stroke is provided.

26 Claims, 3 Drawing Sheets

GYRATORY CRUSHER HAVING DYNAMICALLY ADJUSTABLE STROKE

BACKGROUND OF THE INVENTION

1. Field of the Invention

The invention relates generally to a gyratory or cone crusher.

2. Background of the Related Art

Gyratory crushers or cone crushers are characterized by crushing or crusher heads having a generally cone-shaped outer surface, which are mounted to undergo gyratory motion. The cone-shaped crushing head of a gyratory crusher is generally centered about a head axis that is angularly offset from a vertical crusher axis generally centered through the crusher. The outer surface of the head is generally protected by a replaceable mantel.

The crushers are further characterized by a bowl-shaped member, sometimes referred to as a concave or bonnet, disposed in an inverted position generally over the cone-shaped crushing head and centered about the vertical crusher axis. The inner surface of the bowl-shaped member is protected by a replaceable bowl liner. The outer dimensions of the head and mantel are smaller than the corresponding inner dimensions of the bowl liner. The head is mounted such that there is a space between the mantel and the bowl liner, sometimes referred to as the "crushing chamber" or "crushing cavity". The volume of the crushing cavity can be increased by altering the shape of the exposed surface of the bowl liner and/or the shape of the exposed surface of the mantel. It can also be increased or decreased by vertically adjusting the elevation of the mantel relative to the elevation of the bowl liner. The bowl-shaped member has an upper opening through which material to be crushed can be fed into the crushing cavity.

The smallest distance between the mantel and the bowl liner at the bottom of the crushing cavity is called the "closed side setting" or "setting" of the crusher. The width of the setting determines the size of crushed materials operably produced by the crusher. The setting can be enlarged to increase the size of the crushed material produced by the crusher, and can be decreased to reduce the size of the crushed material produced by the crusher. The setting can be adjusted by simply raising or lowering the elevation of the bowl liner relative to the elevation of the crusher head, or by raising or lowering the elevation of the crusher head relative to the elevation of the bowl liner. The difference between the width of the closed side setting and the spacing between the mantel and the bowl liner at the bottom of the crushing cavity directly opposite from the closed side setting, sometimes called the "open" side or "open side setting", is called the "throw" or "stroke" of the crusher.

The small angular offset of the head axis relative to the vertical crusher axis is provided by mounting the head on an eccentric element, or other suitable mounting. The head is caused to gyrate relative to the bowl-shaped member by rotating that mounting or eccentric element. As the eccentric element rotates, one side of the head is caused to approach the bowl liner until it attains the closed side setting while the opposite side of the head recedes from the bowl liner until it simultaneously attains the open side setting. The closed side setting and open side setting operably travel around the periphery of the lower end of the crushing cavity as the eccentric element is rotated, each making a complete revolution around the crusher head for each revolution on the eccentric element. The magnitude of the gyration is determined by the angle that the head axis is offset from the crusher axis and by the location of the point at which those two axes most closely approach or intersect.

State-of-the-art gyratory or cone crushers are generally driven by a horizontally disposed countershaft which radially extends into a lower part of a generally cylindrical crusher housing. An inner end of the countershaft is coupled through a pinion and ring gear to the eccentric element to rotatably drive the eccentric element.

A motor (either electric or combustion) is used to drive the crusher. The speed of the motor, the size ratio of the pulleys on the motor and the crusher, and the gearing of the eccentric element determine the speed at which the head gyrates, sometimes referred to as the "gyrational speed". The gyrational speed selected for each crusher depends on the particular application for which the crusher is to be used. Increasing or decreasing the gyrational speed is usually a matter of changing the speed of the motor, changing the relative sizes of the pulleys on the motor and/or the crusher, and/or changing the gear ratios for the eccentric.

The gyratory or gyrating motion of the cone-shaped crushing head performs a material comminution action on material, such as rock, ore, coal and other hard substances, as the material is fed through the bowl opening into the crushing cavity. The material typically moves by gravity through the annular space or crushing cavity between the exposed surface of the stationary bowl liner and the exposed surface of the cone-shaped mantel. As the gyrating head approaches the liner, it crushes the material; as it recedes from the liner, the material falls farther down the crushing cavity to undergo further crushings during subsequent revolutions of the eccentric member. As the separation between the bowl liner and the head gradually decreases from top to bottom, such progressive crushing action repeatedly occurs until the crushed material is discharged from the bottom of the crushing cavity.

The crushing heads of prior art gyratory crushers generally utilize two different mounting mechanisms—spider-type, wherein head mounting support is provided both above and below the crushing head, and spiderless, wherein head mounting support is provided only from below the crushing head. Obviously, greater demands are placed on a spiderless mounting mechanism due to the moments randomly generated during crushing processes.

Generally, each prior art crusher has a particular stroke and a particular gyrational speed for a particular application of the crusher. If, however, a user desires to produce a crushed product having different specifications than those for which the crusher was designed, such as a finer product that is produced by a crusher having a shorter stroke and a higher gyrational speed for example, a different crusher having such a shorter stroke and a higher gyrational speed is needed. Obviously, two or more crushers having different strokes and gyrational speeds would require a substantially greater investment in equipment than would a single crusher that could produce both crushed products.

Further, rock taken from different sources or from different locations of a quarry may have different crushing characteristics. As a result, productivity for crushing rock taken from one or both of those sources or locations may be substantially reduced from the optimum productivity anticipated for a particular crusher. In many applications, optimum productivity may be obtainable for such materials having differing crushing characteristics if a crusher was available that had a variable stoke. Although it is known to provide a crusher having a few different strokes, the crusher generally must to shut down and disassembled in order to change the stroke to a different selected one of the few available strokes thereof.

What is needed is a gyratory crusher that has a mechanism for continuously adjusting the stroke of the crusher without having to dismantle the crusher, and, preferably, such a mechanism wherein the stroke can be dynamically continuously adjusted without shutting down the crusher.

SUMMARY OF THE INVENTION

An improved gyratory crusher having a dynamically adjustable stroke mechanism is provided for crushing rock, ore, coal and other hard substances. The gyratory crusher includes a frame structure, including a lower frame portion, an upper frame portion supported by the lower frame portion, and a bonnet supported by the upper frame portion. The bonnet has an upper opening for receiving the material to be crushed.

The gyratory crusher also includes an eccentric member, a main shaft, and a conically shaped crusher head. A first mounting arrangement, including a pair of taper beatings, is provided for mounting the eccentric member to the frame structure such that the eccentric member is rotatable about a vertically oriented crusher axis. A second mounting arrangement, including a spherical bearing, is provided for spiderlessly mounting the main shaft of the eccentric member such that the main shaft is rotatable about a substantially vertically oriented head axis angularly offset from the crusher axis. The crusher head is securely mounted on the main shaft such that the crusher head is rotatable about the head axis and such that a crushing chamber is formed between the crusher head and the bonnet. The gyratory crusher also includes a plurality of hydrostatic bearings configured to operably abuttingly engage and support the crusher head on a lubricant film provided by a lubricating system configured to operatively lubricate the moving components and sliding interfaces of the crusher.

The gyratory crusher also includes a stroke adjusting mechanism for continuously and dynamically adjusting the stroke of the crusher. The stroke adjusting mechanism includes the outer race of the spherical bearing being continuously rotatable about a stroke axis, that is angularly offset from both the crusher and head axes. The stroke adjusting mechanism is configured to provide the crusher with a maximum stroke as the stroke, crusher and head axes are planarly arranged and the crusher and head axes are disposed on opposite sides of the stroke axis, and with a minimum stroke as the stroke, crusher and head axes are planarly arranged and the crusher and head axes are disposed on the same side of the stroke axis. The stroke, crusher and head axes are configured to intersect at a common apex.

The stroke adjusting mechanism includes a hydraulic drive mechanism for rotating the outer race relative to the eccentric member about the stroke axis. A distribution system, including a rotary hydraulic connector, distribution lines and ports, provides pressurized hydraulic fluid for powering the hydraulic motor or motors. A lock check valve interposed in the distribution system controls the flow of hydraulic fluid to and from the hydraulic motor. The drive mechanism includes a worm gear driven by the hydraulic motor and a worm gear receiver, formed in or connected to the outer race and matingly engaged with the worm gear. Alteratively, the outer race may be rotated relative to the eccentric member by a single- or multiple-piston arrangement.

In addition to an "on-the-go" or dynamically continuously adjustable stroke, the crusher of the present invention includes structure for: (1) continuous "on-the-go" or dynamic adjustment of gyratory speed, (2) continuous "on-the-go" or dynamic adjustment of "closed side setting", (3) continuous "on-the-go" or dynamic adjustment of both stroke and gyratory speed, (4) continuous "on-the-go" or dynamic adjustment of both stroke and "closed side setting", (5) continuous "on-the-go" or dynamic adjustment of both gyratory speed and "closed side setting", and (6) continuous "on-the-go" or dynamic adjustment of stroke, gyratory speed and "closed side setting".

The gyratory crusher also includes a flexible seal that is configured to operatively protect moving components thereof, including the first and second mounting arrangements and the plurality of hydrostatic bearings, from dust and grit generated during crushing operations. An outer edge of the flexible seal is secured to the crusher head and an inner edge of the flexible seal is secured to an outer race of a ball bearing seal, the inner race of which is secured to non-rotating members of the mounting arrangement.

A driving arrangement, including a bevel gear centered about the crusher axis and secured to the eccentric member, provides power for operating the crusher.

The present invention includes a method of continuously and dynamically adjusting the stroke of a gyratory crusher.

PRINCIPAL OBJECTS AND ADVANTAGES OF THE INVENTION

The principal objects and advantages of the present invention include: providing a gyratory crusher that has a continuously adjustable stroke; providing such a gyratory crusher that has a dynamically adjustable stroke; providing such a gyratory crusher that has a dynamically and continuously adjustable gyrational speed; providing such a gyratory crusher that has a dynamically and continuously adjustable closed side setting; providing such a gyratory crusher that has a stroke and a gyrational speed that are dynamically and continuously adjustable; providing such a gyratory crusher that has a stroke and a closed side setting that are dynamically and continuously adjustable; providing such a gyratory crusher that has a gyrational speed and a closed side setting that are dynamically and continuously adjustable; providing such a gyratory crusher that has a stroke, a gyrational speed, and a closed side setting that are dynamically and continuously adjustable; and generally providing such a gyratory crusher that is efficient in operation, capable of long operating life, and particularly well adapted for the proposed usages thereof.

Other objects and advantages of this invention will become apparent from the following description taken in conjunction with the accompanying drawings wherein are set forth, by way of illustration and example, certain embodiments of this invention.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
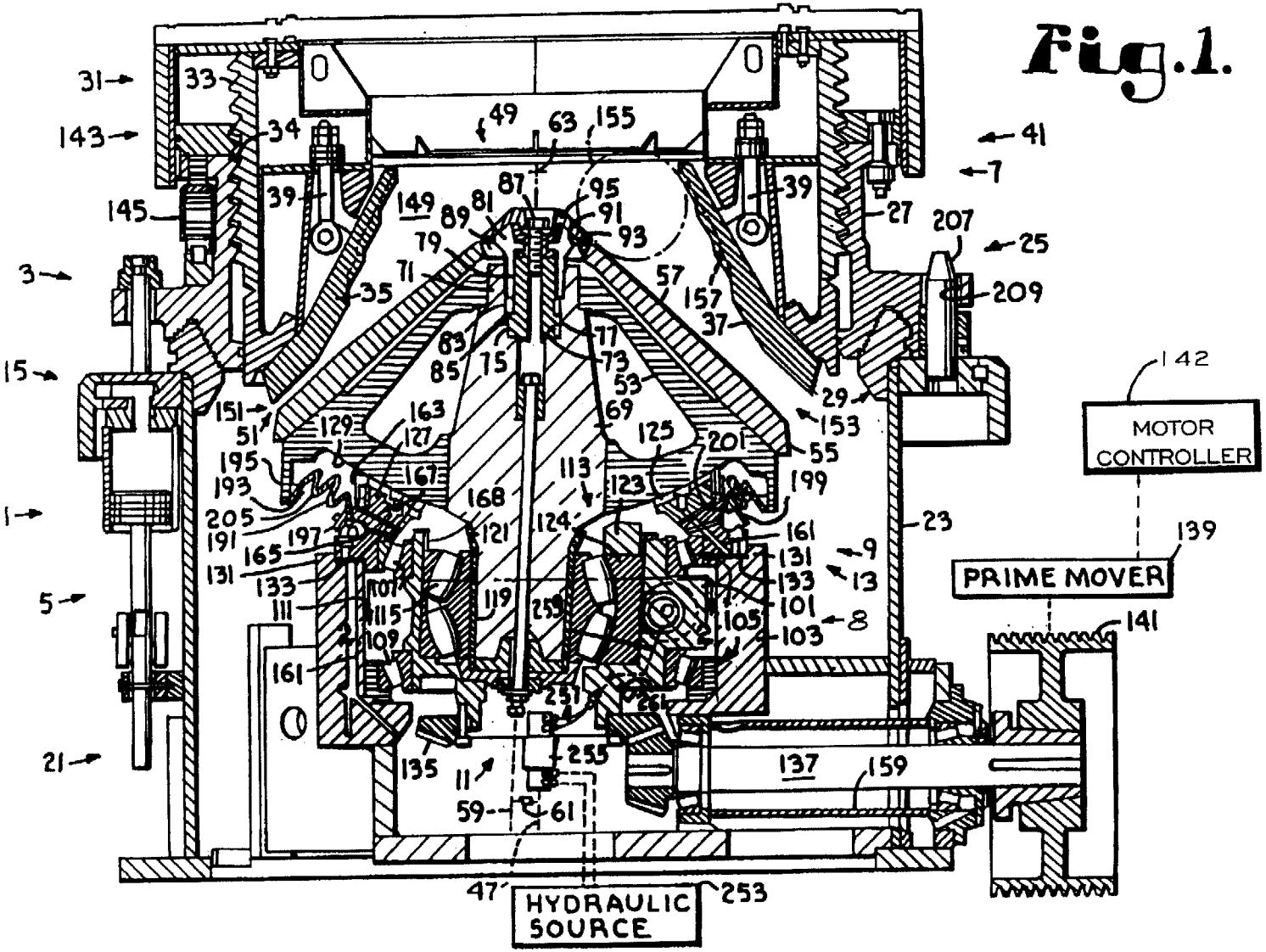
FIG. 1 is a fragmentary, partially cross-sectional, partially schematic, side elevational view of a gyratory crusher having a dynamically adjustable stroke mechanism, according to the present invention.
Figure 2:
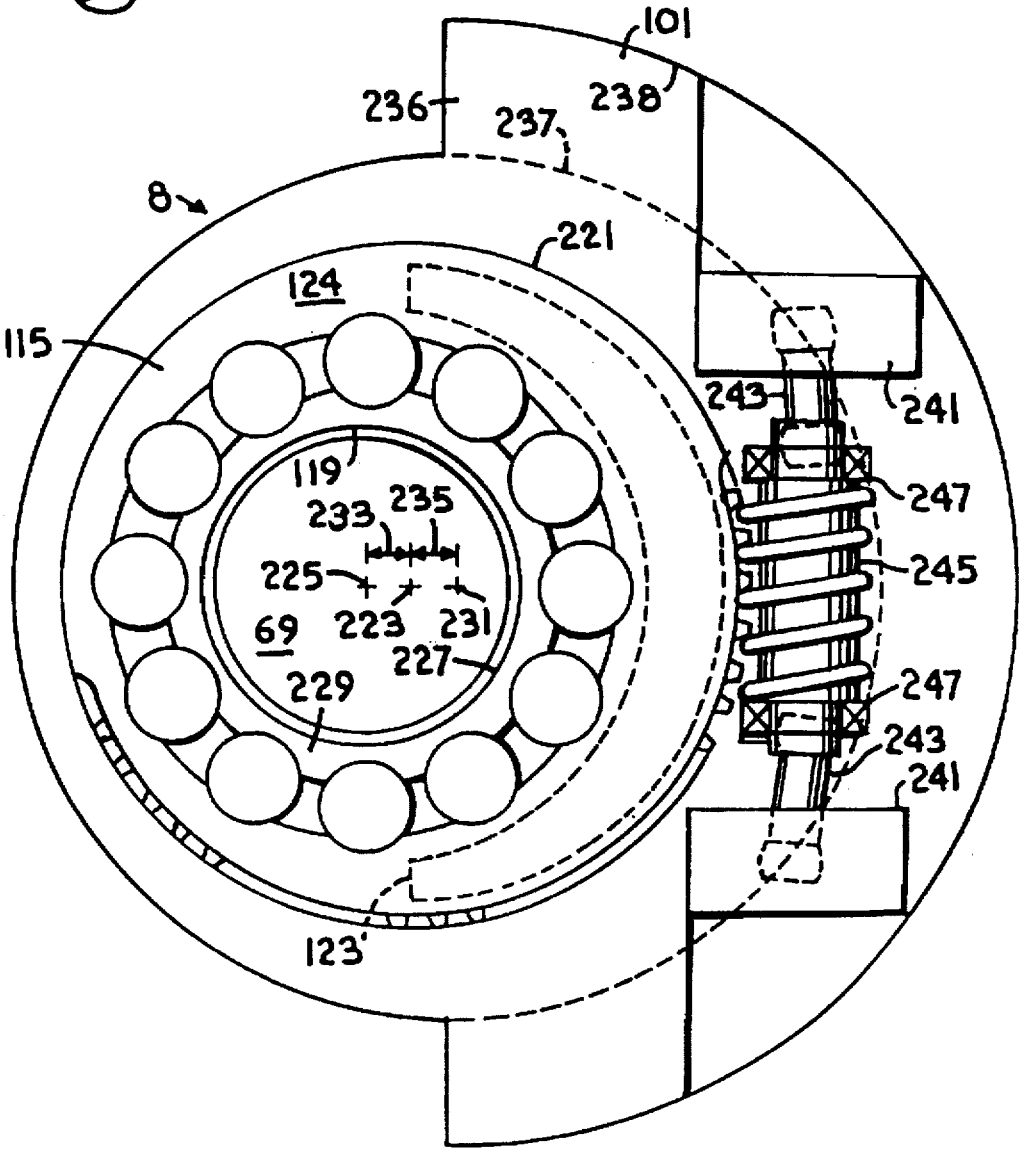
FIG. 2 is an enlarged and fragmentary, schematic cross-sectional view of the gyratory crusher having a dynamically adjustable stroke mechanism, taken along line 2—2 of FIG. 1, showing an eccentric outer race of a spherical bearing rotated relative to an eccentric member such that centers of curvature of the inside diameter of an inner race of the spherical bearing, the outside diameter of the outer race of the spherical bearing, and taper bearings mounting the eccentric in linear alignment, and also schematically showing a counterweight attached to the outer race in phantom lines.

The reference numeral 1 generally refers to a gyratory crusher in accordance with the present invention, as shown somewhat simplified to highlight particular features of the present invention in FIGS. 1 and 2. The crusher 1 includes frame structure 3, head mounting means 5, gap or "closed side setting" adjusting means 7, stroke adjusting means 8, lubricating means 9, head hold-down means 11, dust seal means 13, and a tramp iron relief system 15.

The frame structure 3 includes a lower frame portion 21 having a wall 23 and an upper frame portion 25 having a wall 27. A "V-seat" arrangement 29 is peripherally situated between the lower frame portion 21 and the upper frame portion 25, similar to that disclosed in U.S. Pat. No. 4,773,604 entitled "SEAT MEMBER FOR GYRATORY ROCK CRUSHER BOWLS" and issued Sep. 27, 1988. A bowl, concave or bonnet 31 is mounted on the upper frame portion 25 by threads 33 thereof mating with threads 34 of the upper flame portion 25. A bowl liner 35 having an exposed surface 37 is replaceably mounted on the bonnet 31 by liner connectors 39 by methods known by those with skill in the art.

The bowl liner 35 is a wear item that is replaceable while the crusher 1 is shut down during a maintenance procedure. The upper frame portion 25, the bonnet 31 and the bowl liner 35, which may sometimes be collectively referred to herein as an upper assembly 41, are all generally centered about a vertically oriented crusher axis 47, located generally centrally of the crusher 1. The bowl liner 35 has the general profile of a hollow truncated cone with a generally circularly shaped upper opening 49 and a wider, generally circularly shaped lower opening 51. The upper opening 49 provides a material feed or intake opening for the crusher 1.

Extending upwardly through the lower opening 51 and into the space encompassed by the bowl liner 35, is a crusher head or crusher head 53 of the crusher 1. The crusher head 53 is generally conically shaped. A mantel 55, another wear item, replaceably mounted on the crusher head 53, provides a conical upwardly facing crushing surface 57 for the crusher head 53. The crusher head 53 is centered about a generally vertically oriented head axis 59, which is disposed and supported at an angle of deviation or angular offset with respect to the crusher axis 47, as indicated by the numeral 61. The head axis 59 and the crusher axis 47 intersect at an apex of gyration or apex 63 that generally lies centrally above the crusher head 53. During operation of the crusher 1, the crusher head 53 gyrates about the apex 63 with respect to the bonnet 31.

The head mounting means 5 includes a main shaft 69, centered about the head axis 59, for receiving the crusher head 53 thereon. An upper end 71 of the main shaft 69 has a tapped partial bore 73 for threadably receiving a mantel stud 75. It should be noted that the main shaft 69 and the crusher head 53 are spiderlessly mounted in the crusher 1.

The mantel stud 75 has an inner threaded portion 77 for mating with the tapped partial bore 73 and an outer threaded portion 79 for mating with a mantel nut 81. The handedness of the inner threaded portion 77 and the outer threaded portion 79 is such that the mantel stud 75 and the mantel nut 81 are self-tightening. The threads of the inner threaded portion 77 and the outer threaded portion 79 have an appropriate pitch, such as four threads per inch for the outer threaded portion 79 and six threads per inch for the inner threaded portion 77, for example.

At least one, preferably two or more, partial bores 83, aligned parallel with the head axis 59, are located across the mated threads of the partial bore 73 and the inner threaded portion 77 for receiving a respective dowel pin 85 therein. The dowel pins 85 are adapted to prevent over-tightening of the mantel stud 75 during the crushing operations and to thereby facilitate subsequent removal or replacement of the mantel stud 75, thereby allowing low-cost replacement of a corresponding thread system that holds a mantel bolt 87 without having to remove or replace the main shaft 69.

The mantel 55 is attached to the crusher head 53 by placing the mantel 55 on the crusher head 53 and positioning a mantel washer or "torch ring" 89 over the outer threaded portion 79. The mantel nut 81, which is configured to be threadably advanceable along the outer threaded portion 79, has outwardly tapered shoulders 91 which, in conjunction with the mantel washer 89 and an appropriately sized and shaped mantel orifice 93 through the mantel 55, centers and secures the mantel 55 to the crusher head 53. A mantel cap 95 is secured to the mantel nut 81 by the bolt 87 to protect the mantel nut 81 and the mantel washer 89 from material falling through the upper opening 49.

The head mounting means 5 also includes an eccentric member 101 mounted within an encasement portion 103 of the lower frame portion 21. Rotational movement of the eccentric member 101 relative to the encasement portion 103 is provided by a first or eccentric mounting arrangement 105, such as a pair of opposing taper bearings 107, 109 centered about the crusher axis 47.

The eccentric member 101 is mounted in a cavity 111 centered about the crusher axis 47 within the encasement portion 103. Rotational movement of the crusher head 53 relative to the eccentric member 101 is provided by a second or shaft mounting arrangement 113, such as a spherical bearing 115 having an inner race centered about the head axis 59. A bushing 119 and a spacer 121 about the main shaft 69 appropriately locate the spacing of the main shaft 69 relative to the inner race of the spherical bearing 115. Counterweight 123 can be attached to an outer portion of race 124 of the spherical bearing 115, as shown in FIG. 1 and as shown in phantom lines in FIGS. 2–6, to rebalance the eccentric member 101 to compensate for changes in gyratory forces arising from adjustments in the stroke, as hereinafter described. If desired, separate additional counterweight may be attached to the eccentric member 101.

To provide adequate mounting for the taper bearings 107, 109 while also providing added support for the substantial stress forces generated during the crushing operating, the crusher head 53 is mounted in abutting engagement with a plurality of hydrostatic bearings 125, mounted on thrust seats 127 spaced generally equidistantly around the crusher axis 47. A bottom surface 129 of the crusher head 53 is spherically shaped, with the center of curvature thereof located at the apex 63, such that the abutting engagement between the hydrostatic bearings 125 and the surface 129 form a sliding interface as the crusher head 53 gyrates and rotates during the crushing operations.

The thrust seats 127 are mounted on and jointly supported by an upper end 131 of the encasement portion 103. Selected ones of a plurality of shims 133 having different thicknesses provide the desired loading of the taper bearings 107, 109. In so doing, the eccentric member 101 is precisely axially located relative to the encasement portion 103.

By precisely mounting and locating the eccentric member 101 relative to the encasement portion 103 with the taper bearings 107, 109, a gear 135, such as a bevel gear, can be centered about the crusher axis 47 and attached directly to the eccentric member 101, thereby eliminating the more complicated, more expensive and higher maintenance gear arrangements of prior art crushers. A drive train or drive pinion arrangement 137, meshed with the gear 135 and connected to a prime mover 139 through a sheave 141, or other suitable means, provides means for powering the crusher 1. Preferably, the prime mover 139 has a continuously adjustable operational speed, such as an appropriately sized electric motor driven by a variable frequency motor controller 142 as provided by Allen Bradley, to thereby provide a continuously adjustable gyrational speed for the crusher, "on-the-go" or dynamically if desired. For example, the gyrational speed of the crusher 1 could be operated at a maximum or at some fraction thereof, such as sixty percent of maximum.

By speeding up the gyrational speed for a particular application of the crusher 1, the "closed side setting" of the crusher 1 can be correspondingly reduced to thereby increase production of the crusher 1 without inducing "bowl float" as commonly known by those skilled in the art. Another benefit obtainable by operating the crusher 1 at a faster gyrational speed is the production of crushed product having a tighter "spec", i.e. a smaller spread in sizes of particles produced by the crusher 1. As a result, the recirculating load in closed circuit crushing operations may be minimized or eliminated for some applications.

The crushing operation is effected by the spacing between the crusher head 53 and the bonnet 31 or, more particularly, the spacing between the mantel 55 and the bowl liner 35. Included conical angles of the bowl liner 35 and the mantel 55 are configured to provide an annular space or crushing chamber 149 between the bowl liner surface 37 and the mantel surface 57, the width thereof generally decreasing downwardly. An annular gap 151 at the lower opening 51 between the bowl liner 35 and the mantel 55, sometimes referred to as the "closed side setting" in reference to the smallest spacing at the lower opening 51 between the bowl liner 35 and the mantel 55, constitutes an annular material discharge opening 153 from the crushing chamber 149. During operation of the crusher 1, material is fed into the crushing chamber 149 through the upper opening 49, which material is gravitationally urged downwardly through the annular crushing chamber 149 and is reduced in size through repeated crushing contacts between the adjacent surfaces 37 and 57 of the bowl liner 35 and the mantel 55.

The maximum size of material that can be crushed by the crusher 1 is determined by the spacing between the uppermost ends of the bowl liner surface 37 and the mantel surface 57, as indicated by the phantom circle designated by the numeral 155. If desired, a plurality of flutes 157 may be formed in the bowl liner surface 37 whereby occasional oversized material may be received by the crushing chamber 149 to thereby increase the effective maximum opening of the crushing chamber 149 without increasing the size of the crusher 1.

A releasable clamping arrangement 143 jams the opposing threads 33, 34 against each other to prevent relative rotation of the threads 33, 34 except when desired. Preferably, the clamping arrangement 143 is activated by hydraulically operated, appropriately spaced cylinders 145.

Wear occurring on the respectively exposed mantel surface 57 and the bowl liner surface 37 tends to increase the spacing therebetween. Consequently, the gap adjusting means 7, which provides the ability to make continuous and "on-the-go" or dynamic adjustments of the spacing between the mantel 55 and the bowl liner 35, includes the threads 33, 34 which permit continuous adjustment of the axial position of the bonnet 31 in a stepless up or down displacement by rotating the bonnet 31 clockwise or counterclockwise, as appropriate, about the crusher axis 47 with respect to the upper frame portion 25. Additionally, the gap adjusting means 7 may be utilized to adjust the size of crushed product produced by the crusher 1 by adjusting the "closed side setting", continuously and dynamically if desired.

To adjust the separation between the mantel 55 and the bowl liner 35, the hydraulic cylinders 145 are bled whereby the jamming pressure between the opposing threads 33, 34 is reduced allowing the mating surfaces of the threads 33, 34 to be displaced relative to each other. If it is desired to increase the separation between the bowl liner 35 and the mantel 55, the threads 33 of the bonnet 31 are rotated relative to the mating threads 34 of the upper frame portion 25 such that the bonnet 31 is threadably advanced upwardly. Conversely, if it is desired to decrease the separation between the bowl liner 35 and the mantel 55, the threads 33 of the bonnet 31 are rotated in the opposite direction relative to the mating threads 34 of the upper frame portion 25 such that the bonnet 31 is threadably advanced downwardly. After attaining the desired separation between the bowl liner 35 and the mantel 55, forces exerted by the clamping arrangement 143 are reasserted to maintain the newly established separation between the bowl liner 35 and the mantel 55.

The lubricating means 9 of the crusher 1 is generally self-contained and includes an arrangement for circulating lubricant through the crusher 1 to lubricate the various moving parts thereof. More specifically, lubricant is pressure pumped from within a casing 159, and/or an oil pan (not shown) associated therewith, and distributed to each of the hydrostatic thrust bearings 125, the eccentric mounting arrangement 105, the shaft mounting arrangement 113, the drive pinion arrangement 137, etc.

The pressurized lubricant is conveyed to the interface between the hydrostatic bearings 125 and the bottom surface 129 of the crusher head 53 by oil channels 161. The lubricant is sufficiently pressurized whereby a thin film of lubricant is continuously forced between each of the hydrostatic bearings 125 and the bottom surface 129 of the crusher head 53. Lubricant sprays outwardly from the interface between the hydrostatic beatings 125 and the bottom surface 129 and, as it cascades downwardly, lubricates the other moving parts of the head mounting means 5 therebelow. Spring loaded wiper rings 163 cause lubricant sprayed radially outwardly from the hydrostatic beatings 125 to be directed downwardly onto a seal bearing 165. Lubricant is gravitationally returned to the casing 159 and/or (unshown) oil pan from the seal bearing 165 and other pockets by weep holes 167.

The head hold-down means 11 is configured to operably prevent vertical displacement of the crusher head 53 relative to the eccentric member 101 and the drive pinion arrangement 137 and thereby prevent levitation of the crusher head 53 from its abutting engagement with the plurality of hydrostatic bearings 125, as taught in an application for patent Ser. No. 08/730,125, entitled "GYRATORY CRUSHER HAVING POSITIVE HEAD HOLD-DOWN MECHANISM" filed concurrently herewith and incorporated herein by reference. As the spherical beating 115 is axially fixedly secured, but not rotationally fixedly secured, relative to the eccentric member 101 by a bracket arrangement 168, and as the eccentric member 101, and, therefore, the hydrostatic bearings 125 via the taper beatings 107, 109, is axially fixedly secured relative to the encasement portion 103, the crusher head 53 and main shaft 69 are prevented from being operably displaced axially relative to the hydrostatic bearings 125.

The dust seal means 13 is adapted to isolate inner moving components, such as the interface between the hydrostatic bearings 125 and the bearings 107, 109 and 115, from abrasive contamination arising from the ubiquitous dust and grit generated during the crushing process. The dust seal means 13 includes a flexible seal 191 having an outer edge 193 secured to a lower extremity 195 of the crusher head 53 and an inner edge 197 secured to an outer race 199 of the seal bearing 165, an inner race 201 of which is secured to the thrust seats 127. Bearing balls are captured between the inner race 201 and the outer race 199 in peripheral grooves thereof.

To provide the flexibility needed to compensate for the oscillatory displacement of the crusher head 53 due to the gyratory motion thereof, the flexible seal 191 generally has a single-wall construction with a corrugation-like cross-sectional configuration. As the separation between the mantel 55 and the bowl liner 35 at a particular point along the gap 151 approaches the closed side setting, the corrugations or ribs 205 widen to compensate for the corresponding increasing separation between the lower extremity 195 and the outer race 199. Similarly, as the separation between the mantel 55 and the bowl liner 35 approaches the open side setting, the ribs 205 become narrower to compensate for the corresponding decreasing separation between the lower extremity 195 and the outer race 199. To compensate for rotation of the crusher head 53 relative to the bowl liner 35 during a crushing operation, the outer race 199 rotates with the crusher head 53, peripherally relative to the inner race 201.

It is to be understood that the dust seal means 13 may comprise other arrangements provided that the moving parts of the crusher 1 are isolated from the abrasive byproducts common to crushing operations.

The tramp iron relief system 15 includes means for hydraulically providing substantial hold-down forces between the upper frame portion 25 and the lower frame portion 21 and for simultaneously providing the ability to allow the bowl liner 35 to automatically elevate relative to the mantel 55 whereby non-crushable material can be rapidly and automatically ejected from the crusher 1, such as a tramp iron relief system as taught in application for patent Ser. No. 08/617,346, entitled "GYRATORY CRUSHER", which is incorporated herein by reference.

The stroke adjusting means 8 includes an outer surface 221 of the outer race 124 of the spherical bearing 115 having an axis or center of curvature 223 that is laterally offset both from an axis or center of curvature 225 of an inner surface 227 of an inner race 229 of the spherical bearing 115 and from an axis or center of rotation 231 of the taper bearings 105, 109. In the example shown in FIG. 2, the center of rotation 231 coincides with the crusher axis 47 and the center of curvature 225 coincides with the head axis 59. It is foreseen that the center of curvature 225 of some applications may be offset from the head axis 59 and/or the center of rotation 231 may be offset from the crusher axis 47.

The spherical bearing 115 is mounted within the eccentric member 101 such that the outer race 124 is rotatable relative to the eccentric member 101 about an axis 223 that passes through the center of curvature 223 and, preferably, also passes through the apex 63, such that both the axes 223 and 225 are planarly arranged and the axes 223 and 231 are planarly arranged. The stroke of the gyratory crusher 1 depends on the spacing 232 between the center of curvature 225 and the center of rotation 231: the greater the spacing 232, the greater the stroke. Conversely, the smaller the spacing 232 between the center of curvature 225 and the center of rotation 231, the shorter the stroke of the crusher 1.

The spacing 232 between the center of curvature 225 and the center of rotation 231—and therefore the stroke of the crusher 1—is adjustable, "on-the-go" or dynamically if desired, by rotating the outer race 124 of the spherical bearing 115 relative to the eccentric member 101 about the axis 223. If the center of curvature 225 and the center of rotation 231 are spaced on opposite sides of the center of curvature 223 such that the centers of curvature 223, 225 and 231 are aligned along a straight line, i.e., the axes 223, 225 and 231 are planarly arranged, as shown in FIG. 2, and wherein the spacing 232 equals the combined distance between the centers of curvature 223 and 225, designated by the numeral 233 in FIG. 2, and the distance between the center of curvature 223 and the center of rotation 231, designated by the numeral 235, a maximum stroke is provided for the crusher 1.

Figure 3:
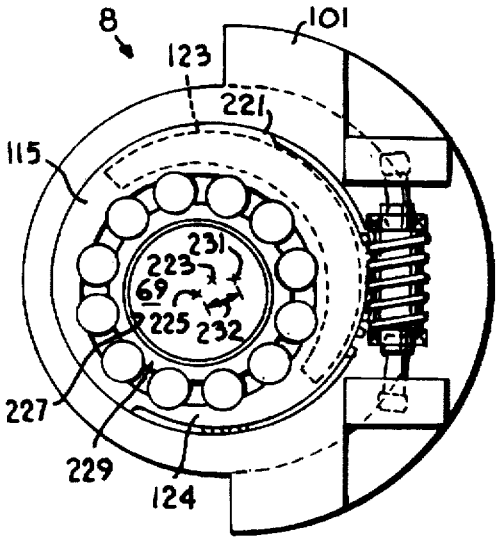
FIG. 3 is a fragmentary, schematic view of the gyratory crusher having a dynamically adjustable stroke mechanism, similar to FIG. 2, but showing the outer race rotated forty-five degrees from the linear alignment shown in FIG. 2.
Figure 4:
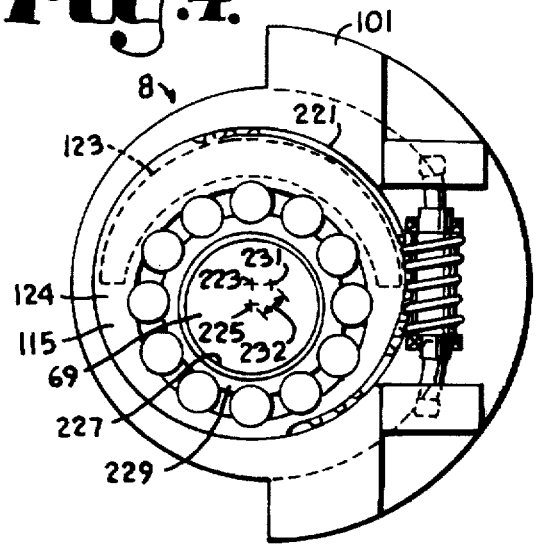
FIG. 4 is a fragmentary, schematic view of the gyratory crusher having a dynamically adjustable stroke mechanism, similar to FIG. 2, but showing the outer race rotated ninety degrees from the linear alignment shown in FIG. 2.
Figure 5:
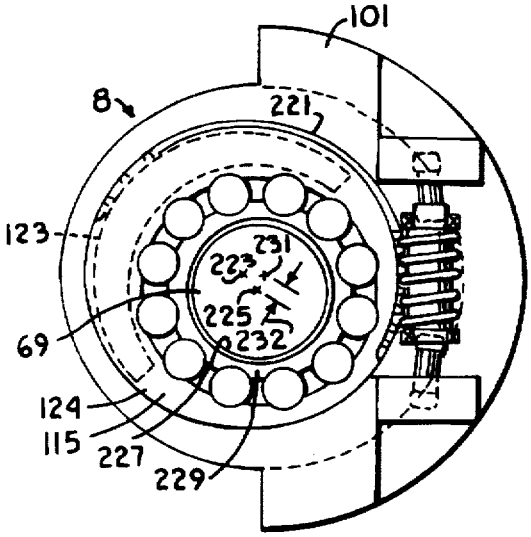
FIG. 5 is a fragmentary, schematic view of the gyratory crusher having a dynamically adjustable stroke mechanism, similar to FIG. 2, but showing the outer race rotated one hundred thirty-five degrees from the linear alignment shown in FIG. 2.

It should be understood that the centers 223, 225 and 231 do not have to remain in an inline relationship as shown in FIG. 2. For example, the outer race 124 may be rotated from the aforesaid inline relationship by 45° as shown in FIG. 3, by 90° as shown in FIG. 4, and by 135° as shown in FIG. 5. By comparing FIGS. 3–5, note that the spacing 232—and therefore the stroke of the crusher 1—becomes progressively shorter than the spacing 232 corresponding to the inline magnitude of the spacing 232 as the angular rotation of the outer race 124 from the aforesaid inline relationship is increased.

Figure 6:
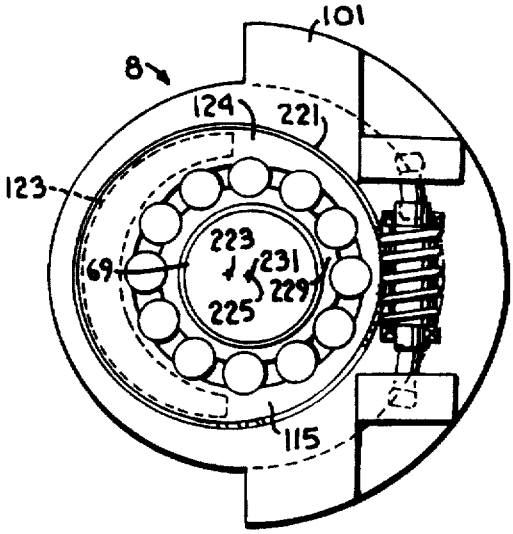
FIG. 6 is a fragmentary, schematic view of the gyratory crusher having a dynamically adjustable stroke mechanism, similar to FIG. 2, but showing the outer race rotated one hundred eighty degrees from the linear alignment shown in FIG. 2, according to the present invention.

If the outer race 124 is rotated relative to the eccentric member 101 by 180° from the aforesaid inline relationship, the axes 223, 225 and 231 are again planarly arranged and the centers 223, 225 and 231 assume another inline relationship wherein the center of curvature 225 and the center of rotation 231 are spaced on the same side of the center of curvature 223 to thereby provide a minimum stroke for the crusher 1. If the distance 232 is equal to the distance 235, then the center of curvature 225 would coincide with the center of rotation 231, as shown in FIG. 6, wherein such minimum stroke would be a zero stroke configuration for the crusher 1.

It should be obvious that the outer race 124 is continuously rotatable about the axis 223 relative to the eccentric member 101; therefore, the stroke of the crusher 1 is also continuously adjustable between a minimum stroke and a maximum stroke. It is foreseen that many applications of the present invention will provide a rotation of the outer race 124 relative to the eccentric member 101 from the inline relationship of the centers 223, 225 and 231, described herein, up to 90° to 120° from the inline relationship, which would provide a continuous range of strokes for the crusher 1 from a maximum stroke to a stroke of approximately 50–70 percent of the maximum stroke. However, other applications of the present invention may permit continuous 180°-rotation of the outer race 124 relative to the eccentric member 101 from the inline relationship of the centers 223, 225 and 231 that provides the crusher 1 with a maximum stroke to the inline relationship of the centers 223, 225 and 231 that provides the crusher 1 with a minimum stroke as described herein.

As the outer race 124 is rotated relative to the eccentric member 101 and thereby produce maximum stroke as shown in FIG. 2, a counterweight portion 236 of the eccentric member 101, spaced between a perimeter line and a dashed line designated by the respective numerals 237 and 238 in FIG. 2, is spaced on the same side of the center of rotation 231 as the counterweight 123, shown schematically by phantom lines 123 in FIGS. 2–6. In other words, both the counterweight portion 236 and the counterweight 123 cooperatively balance the gyrational forces generated by the gyrating crusher head 53.

As the outer race 124 is rotated forty-five degrees relative to the eccentric member 101 as shown in FIG. 3, gyrating forces operably generated by the counterweight portion 236 and the counterweight 123 still have cooperative components but the overall effect of the counterweight portion 236 and the counterweight 123 has been modified to account for the reduction in stroke resulting from the rotation of the outer race 124 relative to the eccentric member 101. FIGS. 4 and 5 illustrate further modifications of the cooperativeness of the counterweight portion 236 and the counterweight 123 to account for reductions in stroke resulting from rotations of ninety degrees and one hundred thirty-five degrees, respectively, of the outer race 124 relative to the eccentric member 101.

FIG. 6 illustrates the modification of the cooperativeness of the counterweight portion 236 and the counterweight 123 to account for minimum or zero stroke resulting from a rotation of one hundred and eighty degrees of the outer race 124 relative to the eccentric member 101. For a crusher providing a zero stroke as herein described, the counterweight 123 would be configured to conceivably provide a moment of inertia substantially equivalent to the moment of inertia which would exist for an intentionally missing portion oft he eccentric member 101, namely that portion contained between the eccentric member 101 and the dashed line designated by the numeral 239 in FIG. 6. It is to be understood that the counterweight 123 is illustrated schematically and is not necessarily drawn to scale relative to other corresponding or cooperating portions of the eccentric member 101.

To rotate the outer race 124 relative to the eccentric member 101, the stroke adjusting means 8 may include a hydraulic motor 241, attached to the eccentric member 101, such as a gerotor or a rotary motor of the Char-Lynn type, as provided by Eaton Corp. of Minnesota, having high torque and displacement at low speed, for example. Drive shafts 243 may be used to drivingly connect the motor 241 to a worm gear 245 mounted in bearings 247. A worm gear receiver 251, configured to interact with the worm gear 245, is attached to the outer race 124, such as along the outer surface 221 thereof. For example, the receiver 251 may be machined or otherwise formed into the outer race 124, or may be machined or otherwise formed into a collar secured to the outer race 124.

Power for the hydraulic motor 241 is provided by pressurized hydraulic fluid from a source 253 and forced through a rotary hydraulic connector 255, distribution lines 257, and flow ports 259 formed within the eccentric member 101, as shown in FIG. 1. A plurality of flow paths may be provided to supply hydraulic fluid to the motor 241, as needed. A hydraulic lock check valve 261 may be interposed in the flow ports 259 to control the flow of hydraulic fluid to and from the rotary motor 241. Alternatively, the motor 241 may be a linear, piston-type motor 241 attached to the eccentric member 101 and appropriately pivotally connected to the outer race 124. Again, the lock check valve 261 may be used to control the flow of hydraulic fluid to and from such a linear motor.

Further, the outer race 124 may be rotated relative to the eccentric member 101 by rotating the worm gear 245 with a wrench inserted through an access port (not shown) in the lower frame portion 21. Also, the outer race 124 may be placed in a selected one of a plurality of detents (not shown) during assembly, each such detent providing a different spacing between the centers of curvature 225 and 231 and thereby providing a different stroke. Such an arrangement, however, would not provide a continuously adjustable stroke and would require disassembly of the crusher 1 to align the outer race 124 with a different selected one of such a plurality of (unshown) detents.

In an application of the present invention, hydraulic fluid is injected into the system to pressurize the hydraulics of the tramp iron relief system 15 as appropriate to clamp the upper frame portion 25 to the lower frame portion 21, particularly across the V-seat arrangement 29.

The closed side setting is adjusted by displacing the bowl liner 35 upwardly or downwardly as needed. The stroke adjusting means 8 is set to provide a desired stroke for the crusher 1. Lubricant is pumped to the hydrostatic thrust bearings 125, the eccentric mounting arrangement 105, the shaft mounting arrangement 113, and the drive pinion arrangement 137. The prime mover 139 is drivingly engaged with the sheave 141 to initiate gyration of the crusher head 53 relative to the bowl liner 35.

Rock, ores or other materials are dropped through the upper opening 49 of the bowl liner 35 and are crushed between the mantel 55 and the bowl liner 35 as the material being crushed is gravitationally urged through the crushing chamber 149 to be discharged through the gap 151 thereof.

As non-crushable material that is too large to be processed through the crushing chamber 149, sometimes referred to as "tramp iron", is dropped into the crushing chamber 149, a portion of the bowl liner 35 and the associated portion of the upper frame portion 25 are forced upwardly from the crusher head 53, causing the corresponding portion of the V-seat arrangement 29 to separate, allowing the tramp iron to pass through the crushing chamber 149, whereupon the upper frame portion 25 immediately, hydraulically returned to its normal position relative to the lower frame portion 21.

As the V-seat arrangement 29 is disturbed, such as during passage of tramp iron or "bowl float", stop pins 207 prevent rotation of the upper frame portion 25 relative to the lower frame portion 21. Sleeves or inserts 209, as well as the stop pins 207, are readily replaceable to facilitate replacement of worn parts.

If it is determined that productivity of the crusher 1 can be improved, and/or a crushed product meeting different design characteristics can be produced, by adjusting the stroke of the crusher 1, the stroke adjusting means 8 may be adjusted accordingly. It should be obvious that the stroke of the crusher 1 may be dynamically adjusted, i.e. , without shutting down or disassembling the crusher 1 but, instead, while the crusher 1 is actually conducting crushing operations. The gap adjusting means 7 may be adjusted in conjunction with modifications to the stroke adjusting means 8 in order to maintain desired sizing, etc., of the crushed product while improving productivity of the crusher 1 by adjusting the stroke.

It is to be understood that the stroke, gyratory speed, and/or "closed side setting" of the crusher 1 are continuously adjustable "on-the-go" or dynamically, singly or jointly with any one or both of the other of the stroke, gyratory speed or "closed side setting" of the crusher 1.

It is to be understood that while certain forms of the present invention have been illustrated and described herein, it is not to be limited to the specific forms or arrangement of parts described and shown.

What is claimed and desired to be secured by Letters Patent is as follows:

1. A gyratory crusher for crushing material, comprising:

(a) a frame structure;

(b) an eccentric member having a first mounting arrangement configured to rotatably mount said eccentric member to said frame structure about a vertically oriented first axis;

(c) a main shaft having a second mounting arrangement configured to rotatably mount said main shaft to said eccentric member about a substantially vertically oriented second axis angularly offset from said first axis;

(d) a crusher head mounted to said main shaft;

(e) drive means for rotating said eccentric member about said first axis; and (f) stroke adjusting means for selectively continuously adjusting said angular offset of said second axis relative to said first axis such that productivity of said crusher is also selectively continuously adjustable, wherein said stroke adjusting means is substantially axially fixed along said first axis.

2. The gyratory crusher according to claim 1, wherein said stroke adjusting means includes said second mounting arrangement having an outer portion rotatable relative to said eccentric member about a third axis, and wherein said third axis is angularly offset from both said first and second axes.

3. The gyratory crusher according to claim 2, wherein said crusher is configured to have a maximum stroke as said first, second and third axes are planarly arranged and said first and second axes are disposed on opposite sides of said third axis.

4. The gyratory crusher according to claim 2, wherein said crusher is configured to have a minimum stroke as said first, second and third axes are planarly arranged and said first and second axes are disposed on the same side of said third axis.

5. The gyratory crusher according to claim 2, wherein said first, second and third axes intersect at a common apex.

6. The gyratory crusher according to claim 2, wherein said outer portion is continuously adjustable relative to said eccentric member about said third axis.

7. The gyratory crusher according to claim 2, wherein said outer portion is dynamically adjustable relative to said eccentric member about said third axis.

8. The gyratory crusher according to claim 1, wherein:

(a) said first mounting arrangement includes a pair of taper bearings; and (b) said second mounting arrangement includes a spherical bearing.

9. The gyratory crusher according to claim 1, wherein said stroke adjusting means includes said second mounting arrangement comprising a spherical bearing having:

(a) an inner race centered about said second axis; and (b) an outer race configured to be operably rotatable relative to said eccentric member about a substantially vertically oriented third axis wherein said third axis is angularly offset from each of said first and second axes.

10. The gyratory crusher according to claim 9, including second drive means for rotating said outer race relative to said eccentric member about said third axis.

11. The gyratory crusher according to claim 1, wherein said drive means includes a bevel gear centered about said first axis and secured to said eccentric member and a drive pinion arrangement enmeshed with said bevel gear.

12. The gyratory crusher according to claim 1, including:

(a) said frame structure having a lower portion; and (b) a plurality of hydrostatic bearings mounted on said lower portion and configured to operably abuttingly engage said crusher head.

13. The gyratory crusher according to claim 12, wherein said plurality of hydrostatic bearings are mounted such that said eccentric member is prevented from being vertically displaced relative to said lower portion.

14. The gyratory crusher according to claim 12, including seal means for operably protecting said first and second mounting arrangements and said plurality of hydrostatic beatings during use of said crusher.

15. The gyratory crusher according to claim 14, wherein said seal means includes:

(a) a seal bearing having (1) an inner race connected to said lower portion, and (2) an outer race rotatable relative to said inner race; and (b) a flexible member connected between said crusher head and said outer race.

16. The gyratory crusher according to claim 1, wherein said stroke adjusting means is continuously and dynamically adjustable.

17. The gyratory crusher according to claim 16, including gyrational speed adjusting means for continuously and dynamically adjusting the gyrational speed of said gyratory crusher.

18. The gyratory crusher according to claim 16, including gap adjusting means for continuously and dynamically adjusting the closed side setting of said gyratory crusher.

19. The gyratory crusher according to claim 18, including gap adjusting means for continuously and dynamically adjusting the closed side setting of said gyratory crusher.

20. The gyratory crusher according to claim 19, including gap adjusting means for continuously and dynamically adjusting the closed side setting of said crusher.

21. A gyratory crusher for crushing material, comprising:

(a) a frame structure;

(b) an eccentric member having a first mounting arrangement configured to rotatably mount said eccentric member to said frame structure about a vertically oriented first axis;

(c) a main shaft having a second mounting arrangement configured to rotatably mount said main shaft to said eccentric member about a substantially vertically oriented second axis angularly offset from said first axis, wherein said second mounting arrangement is substantially axially fixed along said second axis;

(d) a crusher head mounted to said main shaft;

(e) drive means for rotating said eccentric member about said first axis; and (f) gyrational speed adjusting means for continuously and dynamically adjusting the gyrational speed of said crusher.

22. A method of adjusting the stroke of a gyratory crusher having an eccentric rotatably mounted about a vertically oriented first axis and a conical head rotatably mounted about a substantially vertically oriented second axis by a mounting arrangement having an inner portion centered about the second axis and an outer portion centered about a substantially vertically oriented third axis wherein the mounting arrangement is substantially axially fixed along the first axis and wherein the second axis is angularly offset from the first axis and intersects the first axis at an apex, said method comprising the steps of selectively rotating the outer portion about the third axis such that the stroke is continuously increasable by increasing the angular offset of the second axis relative to the first axis and is continuously decreasable by decreasing the angular offset of the second axis relative to the first axis.

23. A gyratory crusher for crushing material, comprising:

(a) a frame structure;

(b) an eccentric member having a first mounting arrangement configured to rotatably mount said eccentric member to said frame structure about a vertically oriented first axis;

(c) a main shaft having a second mounting arrangement configured to rotatably mount said main shaft to said eccentric member about a substantially vertically oriented second axis angularly offset from said first axis;

(d) a crusher head mounted to said main shaft;

(e) drive means for rotating said eccentric member about said first axis;

(f) stroke adjusting means for adjusting said angular offset of said second axis relative to said first axis; said stroke adjusting means includes said second mounting arrangement comprising a spherical bearing having:

(1) an inner race centered about said second axis, and (2) an outer race configured to be operably rotatable relative to said eccentric member about a substantially vertically oriented third axis wherein said third axis is angularly offset from each of said first and second axes; and (g) second drive means for rotating said outer race relative to said eccentric member about said third axis; said second drive means includes a hydraulic motor attached to said eccentric member.

24. A gyratory crusher for crushing material, comprising:

(a) a frame structure;

(b) an eccentric member having a first mounting arrangement configured to rotatably mount said eccentric member to said frame structure about a vertically oriented first axis;

(c) a main shaft having a second mounting arrangement configured to rotatably mount said main shaft to said eccentric member about a substantially vertically oriented second axis angularly offset from said first axis;

(d) a crusher head mounted to said main shaft;

(e) drive means for rotating said eccentric member about said first axis;

(f) stroke adjusting means for adjusting said angular offset of said second axis relative to said first axis; said stroke adjusting means includes said second mounting arrangement comprising a spherical bearing having:

(1) an inner race centered about said second axis, and (2) an outer race configured to be operably rotatable relative to said eccentric member about a substantially vertically oriented third axis wherein said third axis is angularly offset from each of said first and second axes; and (g) second drive means for rotating said outer race relative to said eccentric member about said third axis; said second drive means including a worm gear and a worm gear receiver matingly engaged therewith.

25. The gyratory crusher according to claim 23, further comprising distribution means, including a rotary hydraulic connector, for distributing hydraulic fluid to said hydraulic motor.

26. The gyratory crusher according to claim 25, including a lock check valve interposed in said distribution means, said lock check valve configured to operatively control flow of hydraulic fluid to and from said hydraulic motor.

* * * * *